US011361711B2

(12) United States Patent
Dong

(10) Patent No.: US 11,361,711 B2
(45) Date of Patent: Jun. 14, 2022

(54) PIXEL CIRCUIT AND DRIVING METHOD THEREOF, DISPLAY SUBSTRATE, AND DISPLAY APPARATUS

(71) Applicant: BOE TECHNOLOGY GROUP CO., LTD., Beijing (CN)

(72) Inventor: Tian Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 271 days.

(21) Appl. No.: 16/618,876

(22) PCT Filed: May 31, 2019

(86) PCT No.: PCT/CN2019/089629
§ 371 (c)(1),
(2) Date: Dec. 3, 2019

(87) PCT Pub. No.: WO2020/098262
PCT Pub. Date: May 22, 2020

(65) Prior Publication Data

US 2021/0327348 A1 Oct. 21, 2021

(30) Foreign Application Priority Data

Nov. 13, 2018 (CN) ..... 201811347822.1

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC .... G09G 3/30–3291; G09G 2300/0809–0871; G09G 2320/0233; G09G 2320/045
See application file for complete search history.

(56) References Cited

U.S. PATENT DOCUMENTS 8,749,595 B2 * 6/2014 Nathan ..... G09G 3/3258 345/690
9,355,595 B2 5/2016 Qi et al.
(Continued)

FOREIGN PATENT DOCUMENTS

CN 102708792 A 10/2012
CN 103050080 A 4/2013
(Continued)

OTHER PUBLICATIONS

Office Action dated Nov. 28, 2019, issued in counterpart CN Application No. 201811347822.1, with English translation. (17 pages).
(Continued)

*Primary Examiner* — Patrick F Marinelli
(74) *Attorney, Agent, or Firm* — WHDA, LLP

(57) ABSTRACT

A pixel circuit, comprising: a compensation sub-circuit (30), and a storage sub-circuit (40). The compensation sub-circuit (30) is configured to adjust a potential of a second node (P2) based on a potential of a first node (P1) in response to a first control signal from a first control signal terminal (S1), and to adjust a potential of the control node (P3) based on a potential of a first terminal of a driving transistor (M0) in response to a second control signal from a second control signal terminal (S2). The storage sub-circuit (40) is configured to adjust the potential of the control node (P3) based on the potential of the second node (P2). The driving transistor (M0) is a N-type transistor.

18 Claims, 5 Drawing Sheets

(52) U.S. Cl.
CPC ..... *G09G 2300/0861* (2013.01); *G09G 2320/0233* (2013.01); *G09G 2320/045* (2013.01)

(56) References Cited

U.S. PATENT DOCUMENTS

| | | | | |
|---|---|---|---|---|
| 9,779,662 | B1 * | 10/2017 | Zhang | G09G 3/3233 |
| 9,824,630 | B2 * | 11/2017 | Lai | G09G 3/3233 |
| 10,546,535 | B2 * | 1/2020 | Dong | G09G 3/3266 |
| 2009/0040150 | A1 * | 2/2009 | Senda | G09G 3/3233 345/76 |
| 2009/0135107 | A1 * | 5/2009 | Kim | G09G 3/3233 345/76 |
| 2011/0141160 | A1 * | 6/2011 | Nathan | G09G 3/3258 345/690 |
| 2013/0222440 | A1 * | 8/2013 | Ikeda | H05B 33/08 345/690 |
| 2013/0271435 | A1 * | 10/2013 | Uchino | G09G 3/3233 345/204 |
| 2016/0148573 | A1 * | 5/2016 | Lai | G09G 3/3233 345/205 |
| 2016/0180775 | A1 * | 6/2016 | Kim | G09G 3/3233 345/205 |
| 2016/0372049 | A1 * | 12/2016 | Wang | G09G 3/3233 |
| 2017/0039944 | A1 * | 2/2017 | Ma | G09G 3/3266 |
| 2017/0206838 | A1 * | 7/2017 | Gai | G09G 3/3258 |
| 2017/0236469 | A1 * | 8/2017 | Wang | G09G 3/3233 345/212 |
| 2017/0249903 | A1 * | 8/2017 | Xiang | G09G 3/3266 |
| 2017/0249904 | A1 * | 8/2017 | Li | G09G 3/3233 |
| 2017/0269783 | A1 * | 9/2017 | Yang | G06F 3/0412 |
| 2017/0270862 | A1 * | 9/2017 | Zhang | G09G 3/3233 |
| 2017/0270867 | A1 * | 9/2017 | Zhu | G09G 3/3233 |
| 2018/0130412 | A1 * | 5/2018 | Zhang | G09G 3/3258 |
| 2018/0137824 | A1 * | 5/2018 | Uchino | G09G 3/20 |
| 2018/0218683 | A1 * | 8/2018 | Huangfu | G09G 3/3258 |
| 2019/0019454 | A1 * | 1/2019 | Chen | H01L 51/5221 |
| 2019/0156750 | A1 * | 5/2019 | Dong | H01L 27/3276 |
| 2019/0251904 | A1 * | 8/2019 | Kim | G09G 3/3233 |
| 2019/0259329 | A1 * | 8/2019 | Yamamoto | G09G 3/3233 |
| 2019/0279569 | A1 * | 9/2019 | Zhao | G09G 3/3266 |
| 2019/0347993 | A1 * | 11/2019 | Jiang | G09G 3/3258 |
| 2020/0013336 | A1 * | 1/2020 | Yang | G09G 3/3258 |
| 2020/0175922 | A1 * | 6/2020 | Wang | G09G 3/3233 |
| 2020/0273410 | A1 * | 8/2020 | Yu | G09G 3/3291 |

FOREIGN PATENT DOCUMENTS

| | | | |
|---|---|---|---|
| CN | 106652903 | A | 5/2017 |
| CN | 106652904 | A | 5/2017 |
| CN | 108206008 | A | 6/2018 |
| CN | 109087609 | A | 12/2018 |
| KR | 20090122699 | A | 12/2009 |
| WO | 2018/157613 | A1 | 9/2018 |

OTHER PUBLICATIONS

Translation of International Search Report dated Aug. 30, 2019. Issued in counterpart Application No. PCT/CN2019/089629. (12 pages).

* cited by examiner

PIXEL CIRCUIT AND DRIVING METHOD THEREOF, DISPLAY SUBSTRATE, AND DISPLAY APPARATUS

CROSS-REFERENCE TO RELATED APPLICATIONS

This application claims benefit of the filing date of Chinese Patent Application No. 201811347822.1 filed on Nov. 13, 2018, the disclosure of which is hereby incorporated in its entirety by reference.

TECHNICAL FIELD

The present disclosure relates to the field of display technologies, and in particular, to a pixel circuit and a driving method thereof, a display substrate, and a display apparatus.

BACKGROUND

As a current-type light-emitting apparatus, an organic light-emitting diode (OLED) is increasingly used in high-performance display panels due to its self-illuminating, fast response, and wide viewing angle.

In the related art, as display technologies have advanced, the size of OLED display panels has become larger and larger. Correspondingly, the number of pixel circuits that need to be disposed in the OLED display panel is also increasing. Accordingly, a same power terminal needs to provide a power signal for a larger number of pixel circuits.

BRIEF SUMMARY

An embodiment of the present disclosure provides a pixel circuit. The pixel circuit includes a compensation sub-circuit, and a storage sub-circuit. The compensation sub-circuit is respectively coupled to a first control signal terminal, a second control signal terminal, a first node, a second node, a control node and a first terminal of a driving transistor, and the control node is coupled to a gate of the driving transistor. The compensation sub-circuit is configured to adjust a potential of the second node based on a potential of the first node in response to a first control signal from the first control signal terminal, and to adjust a potential of the control node based on a potential of the first terminal of the driving transistor in response to a second control signal from the second control signal terminal. The storage sub-circuit is respectively coupled to the second node and the control node, and is configured to adjust the potential of the control node based on the potential of the second node. The driving transistor is an N-type transistor.

Optionally, the pixel circuit further comprising: a reset sub-circuit, a data writing sub-circuit, a light-emitting control sub-circuit, and a driving transistor; wherein the reset sub-circuit is respectively coupled to the third control signal terminal, a reference power terminal and the first node, and is configured to output a reference power signal provided by the reference power terminal to the first node in response to the third control signal from the third control signal terminal; the data writing sub-circuit is respectively coupled to the second control signal terminal, a data signal terminal and the second node, and is configured to output a data signal provided by the data signal terminal to the second node in response to the second control signal from the second control signal terminal; the light-emitting control sub-circuit is respectively coupled to a third control signal terminal, a first power terminal, and the first terminal of the driving transistor, and is configured to output a first power signal provided by the first power terminal to the first terminal of the driving transistor in response to a third control signal from the third control signal terminal; and the second terminal of the driving transistor is coupled to the first node, and the first node is coupled to one terminal of a light emitting element.

Optionally, the compensation sub-circuit comprising: a first compensation sub-circuit and a second compensation sub-circuit; the first compensation sub-circuit is respectively coupled to the second control signal terminal, the control node, and the first terminal of the driving transistor, and is configured to adjust the potential of the control node based on the potential of the first terminal of the driving transistor in response to the second control signal; and the second compensation module is respectively coupled to the first control signal terminal, the first node, and the second node, and is configured to adjust the potential of the second node based on the potential of the first node in response to the first control signal.

Optionally, the first compensation sub-circuit comprises a first transistor; a gate of the first transistor is coupled to the second control signal terminal, a first terminal of the first transistor is coupled to the first terminal of the driving transistor, and a second terminal of the first transistor is coupled to the control node.

Optionally, the second compensation sub-circuit comprises: a second transistor; a gate of the second transistor is coupled to the first control signal terminal, a first terminal of the second transistor is coupled to the first node, and a second terminal of the second transistor is coupled to the second node.

Optionally, the reset sub-circuit comprises a third transistor; a gate of the third transistor is coupled to the third control signal terminal, a first terminal of the third transistor is coupled to the reference power terminal, and a second terminal of the third transistor is coupled to the first node.

Optionally, the data writing sub-circuit comprises a fourth transistor; a gate of the fourth transistor is coupled to the second control signal terminal, a first terminal of the fourth transistor is coupled to the data signal terminal, and a second terminal of the fourth transistor is coupled to the second node.

Optionally, the light-emitting control sub-circuit comprises a fifth transistor; a gate of the fifth transistor is coupled to the third control signal terminal, a first terminal of the fifth transistor is coupled to the first power terminal, and a second terminal of the fifth transistor is coupled to the first terminal of the driving transistor.

Optionally, the storage sub-circuit comprises a storage capacitor; one terminal of the storage capacitor is coupled to the second node, and the other terminal of the storage capacitor is coupled to the control node.

Optionally, all transistors in the pixel circuit are oxide thin film transistors or N-type LTPS thin film transistors.

Optionally, all transistors except the driving transistor in the pixel circuit are P-type thin film transistors.

Optionally, transistors included in the data writing sub-circuit and the compensation sub-circuit, and the driving transistor are all N-type transistors, and transistors included in the reset sub-circuit and the light-emitting control sub-circuit are all P-type transistors.

Optionally, transistors included in the data writing sub-circuit and the first compensation sub-circuit are oxide thin film transistors.

Optionally, transistors in the second compensation sub-circuit are P-type thin film transistors, and all other transistors in the pixel circuit are N-type thin film transistors.

Optionally, the driving transistor and transistors in the second compensation sub-circuit are N-type thin film transistors, and all other transistors in the pixel circuit are P-type thin film transistors.

One embodiment of the present disclosure is a driving method of the pixel circuit according to one embodiment of the present disclosure. The method includes a reset phase, a data-writing phase, and a light-emitting phase, wherein in the reset phase, the potential of the first control signal provided by the first control signal terminal is the first potential, the potential of the second control signal provided by the second control signal terminal is the second potential, and the potential of the third control signal provided by the third control signal terminal is the first potential; the reset sub-circuit outputs a reference power signal from the reference power terminal to the first node in response to the first control signal; the data writing sub-circuit outputs the data signal from the data signal terminal to the second node in response to the second control signal; the light-emitting control sub-circuit outputs a first power signal from the first power terminal to the first terminal of the driving transistor in response to the third control signal; the compensation sub-circuit outputs the first power signal to the control node in response to the second control signal; the potential of the first power signal is a second potential; in the data-writing phase, the potential of the third control signal is a second potential, the driving transistor outputs a reference power signal to the first terminal of the driving transistor in response to the control node; the compensation sub-circuit adjusts a potential of the control node based on a potential of the first terminal of the driving transistor in response to the second control signal; and in the light-emitting phase, the potential of the first control signal is a second potential, the potential of the second control signal is a first potential, and the potential of the third control signal is a first potential; the compensation sub-circuit adjusts the potential of the second node based on the potential of the first node in response to the first control signal; the storage sub-circuit adjusts the potential of the control node based on the potential of the second node; the light-emitting control sub-circuit outputs a first power signal to the first terminal of the driving transistor in response to the third control signal.

Optionally, the compensation sub-circuit comprising: a first compensation module and a second compensation module; the first compensation module comprising a first transistor, the second compensation module comprising a second transistor, the reset sub-circuit comprising a third transistor, the data writing sub-circuit comprising a fourth transistor, the light-emitting control sub-circuit comprising a fifth transistor, and the storage sub-circuit comprising a storage capacitor C; in the reset phase, the potentials of the first control signal and the third control signal are both the first potential, and the potential of the second control signal is the second potential; the first transistor, the third transistor, the fourth transistor, and the fifth transistor are all turned on, and the second transistor is turned off; the reference power terminal outputs the reference power signal to the first node through the third transistor, the data signal terminal outputs the data signal to the second node through the fourth transistor, and the first power terminal outputs the first power signal to the control node through the first and fifth transistors; in the data-writing phase, the potential of the third control signal is the second potential, the potential of the control node is the second potential, the driving transistor is turned on, and the fifth transistor is turned off, the reference power signal is outputted to the first terminal of the driving transistor through the driving transistor, and the first transistor adjusts the potential of the control node based on the potential of the first terminal of the driving transistor; in the light-emitting phase, the potential of the first control signal is the second potential, the potential of the second control signal and the potential of the third control signal are the first potential; the second transistor and the fifth transistor are turned on, the first transistor, the third transistor, and the fourth transistor are turned off; the second transistor adjusts the potential of the second node based on the potential of the first node, the storing capacitor adjusts the potential of the control node based on the potential of the second node, and the first power terminal outputs the first power signal to the first terminal of the driving transistor through the fifth transistor.

One embodiment of the present disclosure is a display substrate, comprising: a plurality of pixel units, each of the pixel units comprising a pixel circuit according to one embodiment of the present disclosure.

One embodiment of the present disclosure is a display apparatus, comprising a display substrate according to one embodiment of the present disclosure.

BRIEF DESCRIPTION OF THE DRAWINGS

The subject matter which is regarded as the disclosure is particularly pointed out and distinctly claimed in the claims at the conclusion of the specification. The foregoing and other objects, features, and advantages of the present disclosure are apparent from the following detailed description taken in conjunction with the accompanying drawings in which:

DETAILED DESCRIPTION

Figure 1:
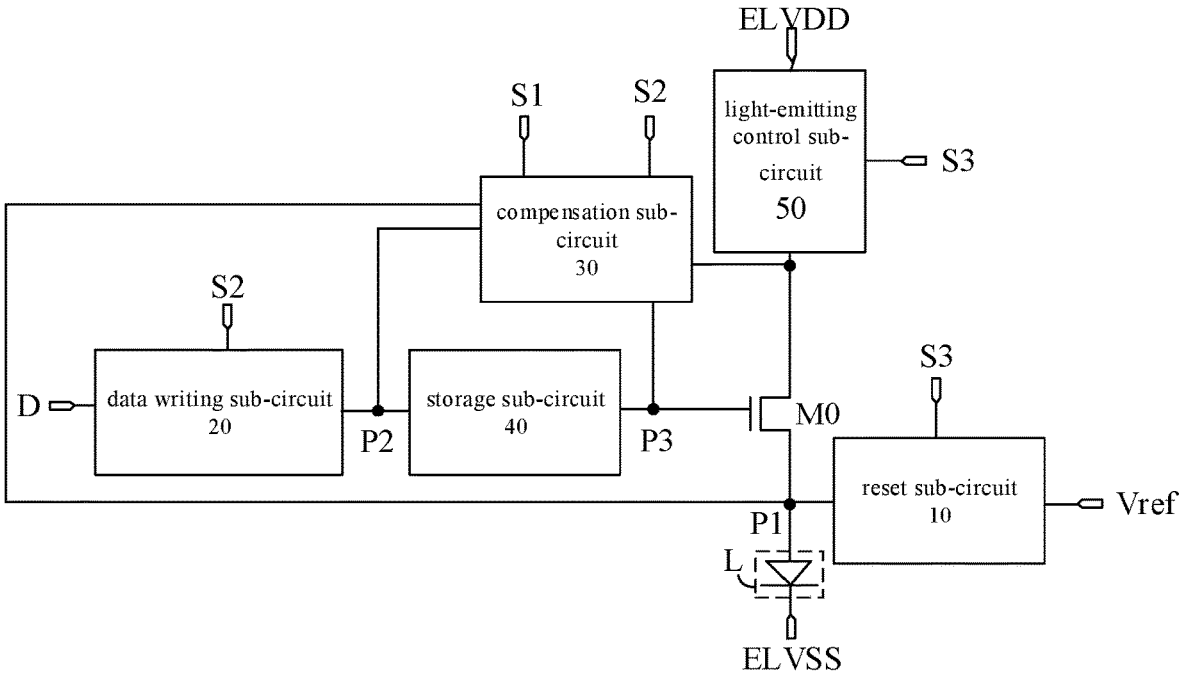
FIG. 1 is a schematic structural diagram of a pixel circuit according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-5. When referring to the figures, like structures and elements shown throughout are indicated with like reference numerals.

Unless otherwise defined, technical terms or scientific terms used in the present disclosure are intended to be in the ordinary meaning of those of ordinary skill in the art. The words "first," "second" and similar words used in the present disclosure do not denote any order, quantity or importance, but are merely used to distinguish different components. The words "including" or "comprising" and the like mean that the element or the item preceding the word includes the element or item listed after the word and its equivalent and do not exclude other components or objects. "Coupled" and the like are not limited to physical or mechanical connections, but may include electrical connections, whether direct or indirect. "Upper," "lower," "left," "right," etc. are only used to indicate the relative positional relationship. When the absolute position of the object being described is changed, the relative positional relationship may also change accordingly.

In the description of the following embodiments, specific features, structures, materials or characteristics may be combined in any suitable manner in any one or more embodiments or examples.

"Coupled" or "connected" and the like are not limited to physical or mechanical connections, but may include electrical connections, and the connections may be direct or indirect.

When a power terminal needs to supply a power signal to a large number of pixel circuits, the signal line set for the power terminal is longer. The power signal provided by the power terminal may decrease as the length of the signal line increases, thereby causing a voltage drop problem and resulting in uneven display brightness of the display panel.

The transistors employed in all embodiments of the present disclosure may each be a thin film transistor or a field effect transistor or other apparatus having the same characteristics. The transistors employed in the embodiments of the present disclosure are mainly switching transistors according to their roles in the circuit. Since the source and the drain of the switching transistor used here are symmetrical, the source and the drain are interchangeable. In the embodiment of the present disclosure, the source is referred to as a first terminal, and the drain is referred to as a second terminal. According to the form in the drawing, the middle terminal of the transistor is the gate, the signal input terminal is the source, and the signal output terminal is the drain. In addition, the switching transistor used in the embodiments of the present disclosure may include any one of a P-type switching transistor or an N-type switching transistor. The P-type switching transistor is turned on when the gate is at a low level and turned off when the gate is at a high level. The N-type switching transistor is turned on when the gate is at a high level and turned off when the gate is at a low level. Furthermore, the plurality of signals in various embodiments of the present disclosure corresponds to a first potential or a second potential respectively. The first potential and the second potential only represent two states of the potential of the signal, and do not mean that the first potential or the second potential has a specific value in the whole text.

FIG. 1 is a schematic structural diagram of a pixel circuit according to one embodiment of the present disclosure. As shown in FIG. 1, the pixel circuit may include a reset sub-circuit 10, a data writing sub-circuit 20, a compensation sub-circuit 30, a storage sub-circuit 40, a light-emitting control sub-circuit 50, and a driving transistor M0.

In one embodiment, the reset sub-circuit 10 is coupled to a third control signal terminal S3, a reference power terminal Vref and a first node P1, respectively. The reset sub-circuit 10 can output a reference power signal provided by the reference power terminal Vref to the first node P1 in response to a third control signal from the third control signal terminal S3.

For example, the reset sub-circuit 10 can output the reference power signal provided by the reference power terminal Vref to the first node P1 when the potential of the first control signal provided by the third control signal terminal S3 is an effective potential.

In one embodiment, the data writing sub-circuit 20 is coupled to a second control signal terminal S2, a data signal terminal D and a second node P2, respectively. The data writing sub-circuit 20 can output a data signal provided by the data signal terminal D to the second node P2 in response to a second control signal from the second control signal terminal S2.

For example, the data writing sub-circuit 20 can output the data signal provided by the data signal terminal D to the second node P2 when the potential of the second control signal provided by the second control signal terminal S2 is an effective potential.

In one embodiment, the compensation sub-circuit 30 is respectively coupled to the first control signal terminal S1, the second control signal terminal S2, the first node P1, the second node P2, a control node P3 and a first terminal of a driving transistor M0. The control node P3 can be coupled to a gate of the driving transistor M0. The compensation sub-circuit 30 can adjust the potential of the second node P2 based on the potential of the first node P1 in response to the first control signal, and can adjust the potential of the control node P3 based on the potential of the first terminal of the driving transistor M0 in response to the second control signal.

For example, the compensation sub-circuit 30 can adjust the potential of the second node P2 based on the potential of the first node P1 when the potential of the first control signal is an effective potential. Furthermore, the compensator circuit 30 can adjust the potential of the control node P3 (i.e., the gate of the driving transistor M0) based on the potential of the first terminal of the driving transistor M0 when the potential of the second control signal is the effective potential.

In one embodiment, the storage sub-circuit 40 is respectively coupled to the second node P2 and the control node P3. The storage sub-circuit 40 can adjust the potential of the control node P3 based on the potential of the second node P2.

For example, the storage sub-circuit 40 can adjust the potential of the control node P3 based on the potential of the second node P2 by coupling.

In one embodiment, the light-emitting control sub-circuit 50 is respectively coupled to the third control signal terminal S3, the first power terminal ELVDD, and the first terminal of the driving transistor M0. The light emitting control sub-circuit 50 may output a first power signal provided by the first power terminal ELVDD to the first terminal of the driving transistor M0 in response to a third control signal from the third control signal terminal S3.

For example, the light-emitting control sub-circuit 50 can output the first power signal provided by the first power terminal ELVDD to the first terminal of the driving transistor M0 when the potential of the third control signal provided by the third control signal terminal S3 is an effective potential.

In one embodiment, the second terminal of the driving transistor M0 is coupled to the first node P1, and the first node P1 is coupled to one terminal of the light-emitting element L. The other terminal of the light-emitting element L can be coupled to the second power terminal ELVSS. The light-emitting element can operate normally under the driving of the driving transistor M0.

In summary, one embodiment of the present disclosure provides a pixel circuit including a compensation sub-circuit and a storage sub-circuit. The compensation sub-circuit can adjust the potential of the control node (i.e., the gate of the driving transistor) based on the potential of the first terminal of the driving transistor, and can adjust the potential of the second node based on the potential of the first node (i.e., the second terminal of the driving transistor). The storage sub-circuit can adjust the potential of the control node based on the potential of the second node. Therefore, when the pixel circuit is driven, the compensation sub-circuit can write the threshold voltage of the driving transistor, the voltage of the reference power signal, the voltage of the data signal, and the potential of the second terminal of the driving transistor to the gate of the driving transistor by controlling the potential of each control signal. The voltage of the first power signal provided by the first power signal terminal is not written to the gate of the driving transistor. Thereby, the magnitude of the driving current output by the driving transistor is independent of the voltage of the first power signal. As a result, the problem of uneven display brightness due to the voltage drop at the first power terminal is avoided.

Figure 2:
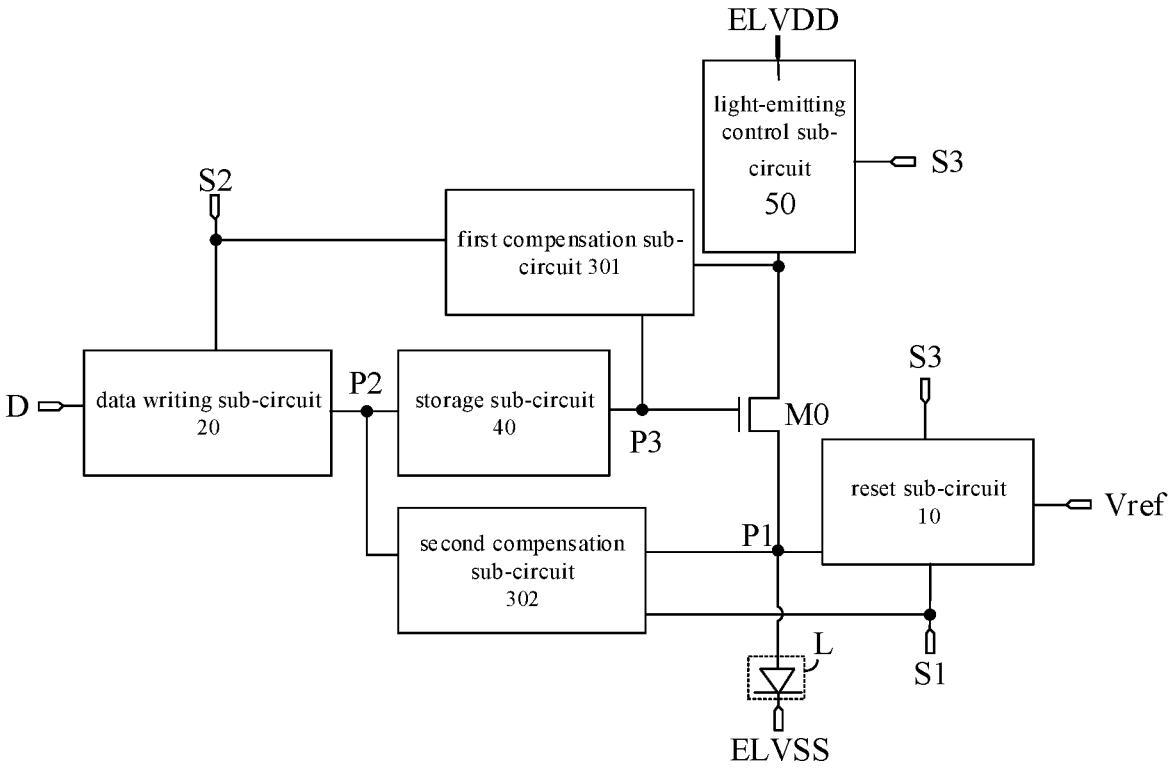
FIG. 2 is a schematic structural diagram of a pixel circuit according to one embodiment of the present disclosure.

FIG. 2 is a schematic structural diagram of a pixel circuit according to one embodiment of the present disclosure. As shown in FIG. 2, the compensation sub-circuit 30 can include a first compensation module 301 and a second compensation module 302.

In one embodiment, the first compensation module 301 is respectively coupled to the second control signal terminal S2, the control node P3 and the first terminal of the driving transistor M0. The first compensation module 301 can adjust the potential of the control node P3 based on the potential of the first terminal of the driving transistor M0 in response to the second control signal.

For example, the first compensation module 301 can adjust the potential of the control node P3 based on the potential of the first terminal of the driving transistor M0 when the potential of the second control signal is an effective potential.

In one embodiment, the second compensation module 302 is respectively coupled to the first control signal terminal S1, the first node P1 and the second node P2. The second compensation module 302 can adjust the potential of the second node P2 based on the potential of the first node P1 in response to the first control signal.

For example, the second compensation module 302 can adjust the potential of the second node P2 based on the potential of the first node P1 when the potential of the first control signal is an effective potential.

Figure 3:
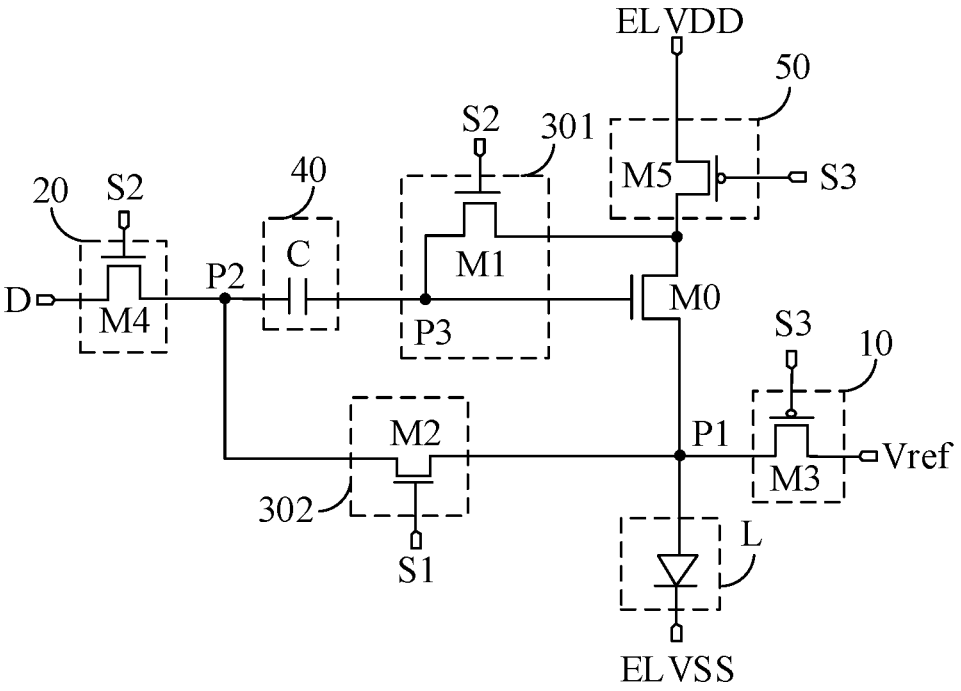
FIG. 3 is a schematic structural diagram of a pixel circuit according to one embodiment of the present disclosure.

FIG. 3 is a schematic structural diagram of a pixel circuit according to one embodiment of the present disclosure. As shown in FIG. 3, the first compensation module 301 can include: a first transistor M1.

In one embodiment, a gate of the first transistor M1 is coupled to the second control signal terminal S2, ae first terminal of the first transistor M1 is coupled to the first terminal of the driving transistor M0, and a second terminal of the first transistor M1 is coupled to the control node P3.

Optionally, referring to FIG. 3, the second compensation module 302 may include: a second transistor M2.

In one embodiment, a gate of the second transistor M2 is coupled to the first control signal terminal S1, a first terminal of the second transistor M2 is coupled to the first node P1, and a second terminal of the second transistor M2 is coupled to the second node P2.

Optionally, referring to FIG. 3, the reset sub-circuit 10 may include: a third transistor M3.

In one embodiment, a gate of the third transistor M3 is coupled to the first control signal terminal S1, a first terminal of the third transistor M3 is coupled to the reference power terminal Vref, and a second terminal of the third transistor M3 is coupled to the first node P1.

Optionally, referring to FIG. 3, the data writing sub-circuit 20 may include: a fourth transistor M4.

In one embodiment, a gate of the fourth transistor M4 is coupled to the second control signal terminal S2, a first terminal of the fourth transistor M4 is coupled to the data signal terminal D, and a second terminal of the fourth transistor M4 is coupled to the second node P2.

Optionally, referring to FIG. 3, the light-emitting control sub-circuit 50 may include: a fifth transistor M5.

In one embodiment, a gate of the fifth transistor M5 is coupled to the third control signal terminal S3, a first terminal of the fifth transistor M5 is coupled to the first power terminal ELVDD, and a second terminal of the fifth transistor M5 is coupled to the first terminal of the driving transistor M0.

Optionally, referring to FIG. 3, the storage sub-circuit 40 may include: a storage capacitor C.

In one embodiment, one terminal of the storage capacitor C is coupled to the second node P2, and the other terminal of the storage capacitor C is coupled to the control node P3. In the embodiment of the present disclosure, the storage capacitor C can adjust the potential of the control node P3 based on the potential of the second node P2 by coupling.

Optionally, referring to FIG. 3, the first node P1 of the pixel circuit may be coupled to one terminal (such as an anode) of the light-emitting element L. The other terminal of the light-emitting element L (such as a cathode) may be coupled to the second power terminal ELVSS. The light-emitting element L can operate normally under the driving of the driving transistor M0.

Moreover, since in the embodiment of the present disclosure, by controlling the control signals, the signal written to the driving transistor M0 is independent of the voltage of the first power signal provided by the first power terminal ELVDD and the threshold voltage of the driving transistor M0. Therefore, not only the problem of non-uniform display brightness of the display panel due to the voltage drop of the first power terminal ELVDD can be avoided, but also the problem of uneven display brightness due to drift of the threshold voltage of the driving transistor M0 can be avoided. As a result, excellent display effect of the display apparatus is effectively ensured.

In the embodiment of the present disclosure, the transistors included in the sub-circuit 20 and the compensation sub-circuit 30 and the driving transistor M0 may all be N-type transistors. The transistors included in the reset sub-circuit 10 and the light-emitting control sub-circuit 50 may all be P-type transistors.

By using both N-type transistors and P-type transistors in the pixel circuit, the voltage drop of the pixel circuit of a complementary metal oxide semiconductor (CMOS) structure can be effectively compensated.

Optionally, the driving transistor M0 and the transistors included in the data writing sub-circuit 20, the reset sub-circuit 10, and the first compensation module 301 may be oxide thin film transistors (TFTs). The transistors included in the light-emitting control sub-circuit 50 and the second compensation module 302 may be low temperature poly crystalline silicon (LTPS) TFTs.

By using both oxide TFTs and LTPS TFTs in the pixel circuit, it is possible to effectively compensate the voltage drop of a low temperature poly crystalline oxide (LTPO) display panel composed of oxide TFTs and LTPS TFTs.

Optionally, all transistors in the pixel circuit are oxide thin film transistors or N-type LTPS thin film transistors.

Optionally, all transistors except the driving transistor in the pixel circuit are P-type thin film transistors.

Optionally, transistors in the second compensation sub-circuit are P-type thin film transistors, and all other transistors in the pixel circuit are N-type thin film transistors.

Optionally, the driving transistor and transistors in the second compensation sub-circuit are N-type thin film transistors, and all other transistors in the pixel circuit are P-type thin film transistors.

In the embodiment of the present disclosure, the potential refers to the voltage of a point relative to a reference point whose potential is zero. The voltage refers to the difference in potential between any two points, so the voltage can also be called the potential difference.

In summary, one embodiment of the present disclosure provides a pixel circuit including a compensation sub-circuit and a storage sub-circuit. The compensation sub-circuit can adjust the potential of the control node (i.e., the gate of the driving transistor) based on the potential of the first terminal of the driving transistor, and can adjust the potential of the second node based on the potential of the first node (i.e., the second terminal of the driving transistor). The storage sub-circuit can adjust the potential of the control node based on the potential of the second node. Therefore, when the pixel circuit is driven, the compensation sub-circuit can write the threshold voltage of the driving transistor, the voltage of the reference power signal, the voltage of the data signal, and the potential of the second terminal of the driving transistor to the gate of the driving transistor by controlling the potential of each control signal, while the voltage of the first power signal provided by the first power signal terminal is not written to the gate of the driving transistor. Thereby, the magnitude of the driving current output by the driving transistor is independent of the voltage of the first power signal. Therefore, the problem of uneven display brightness due to the voltage drop at the first power terminal is avoided.

Figure 4:
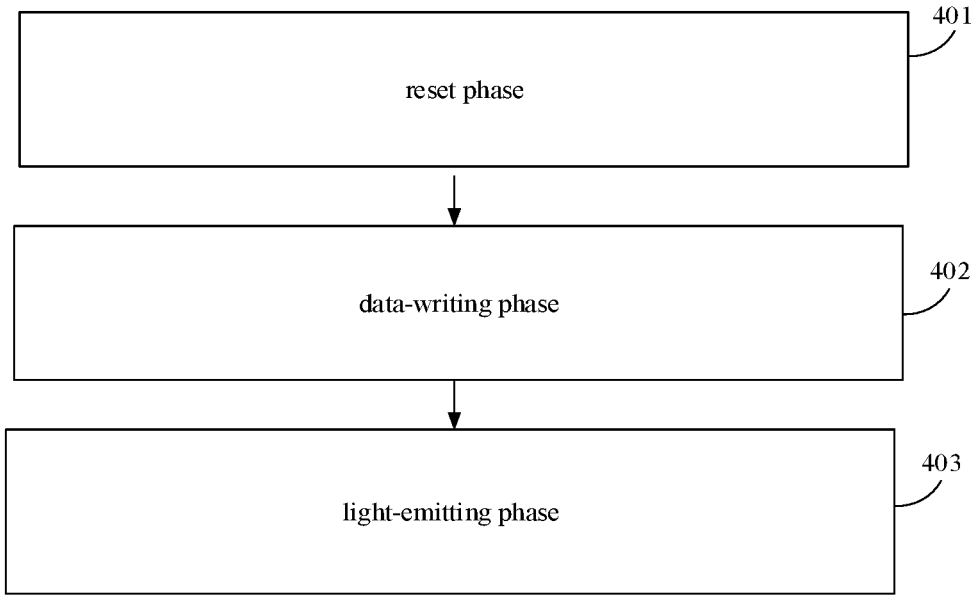
FIG. 4 is a flowchart of a driving method of a pixel circuit according to one embodiment of the present disclosure.

FIG. 4 is a flowchart of a driving method of a pixel circuit according to one embodiment of the present disclosure. The method can be applied to a pixel circuit as shown in any of FIGS. 1 to 3. As shown in FIG. 4, the method may include steps 401-403.

Step 401 is the reset phase. In Step 401, the potential of the first control signal provided by the first control signal terminal is the first potential, the potential of the second control signal provided by the second control signal terminal is the second potential, and the potential of the third control signal provided by the third control signal terminal is the first potential. The reset sub-circuit may output a reference power signal from the reference power terminal to the first node in response to the first control signal; the data writing sub-circuit may output the data signal from the data signal terminal to the second node in response to the second control signal, the light-emitting control sub-circuit may output a first power signal from the first power terminal to the first terminal of the driving transistor in response to the third control signal, and the compensation sub-circuit may output the first power source to the control node in response to the second control signal. The potential of the first power signal is a second potential.

Step 402 is the data-writing phase. In step 402, the potential of the third control signal is a second potential. The driving transistor may output a reference power signal to the first terminal of the driving transistor in response to the control node. The compensation sub-circuit may adjust a potential of the control node based on a potential of the first terminal of the driving transistor in response to the second control signal.

Step 403 is the light-emitting phase. In step 403, the potential of the first control signal is a second potential, the potential of the second control signal is a first potential, and the potential of the third control signal is a first potential. The compensation sub-circuit may adjust the potential of the second node based on the potential of the first node in response to the first control signal. The storage sub-circuit can adjust the potential of the control node based on the potential of the second node. The light-emitting control sub-circuit may output a first power signal to the first terminal of the driving transistor in response to the third control signal.

In summary, the embodiments of the present disclosure provide a driving method of a pixel circuit. Since, in the data-writing phase, the compensation sub-circuit can adjust the potential of the control node (i.e., the gate of the driving transistor) based on the potential of the first terminal of the driving transistor. Furthermore, at this stage, the first power terminal cannot output the first power signal to the first terminal of the driving transistor. Therefore, the compensation sub-circuit can write the threshold voltage of the driving transistor and the voltage of the reference power signal to the gate of the driving transistor. Furthermore, in the light-emitting phase, the compensating sub-circuit can adjust the potential of the second node based on the potential of the first node (i.e., the second terminal of the driving transistor), and the storage sub-circuit can adjust the potential of the control node based on the potential of the second node. Therefore, the compensation sub-circuit can also write the voltage of the second terminal of the driving transistor and the voltage of the data signal to the gate of the driving transistor. Thereby, the signal finally written to the gate of the driving transistor includes the threshold voltage of the driving transistor, the voltage of the reference power signal, the voltage of the data signal, and the potential of the second terminal of the driving transistor, but not the voltage of the first power signal v. Thereby, the magnitude of the driving current outputted by the driving transistor is independent of the voltage of the first power signal provided by the first power terminal. As a result, the problem of uneven display brightness due to the voltage drop at the first power terminal is avoided.

Optionally, referring to FIG. 3, in the embodiment of the present disclosure, the compensation sub-circuit 30 may include: a first compensation module 301 and a second compensation module 302. The first compensation module 301 can include a first transistor M1. The second compensation module 302 can include a second transistor M2. The reset sub-circuit 10 may include a third transistor M3. The data-writing sub-circuit 20 may include a fourth transistor M4. The light-emitting control sub-circuit 50 may include a fifth transistor M5. The storage sub-circuit 40 can include a storage capacitor C.

Taking the pixel circuit shown in FIG. 3 as an example, and by taking a case where the driving transistor M0, the first transistor M1, the second transistor M2, and the fourth transistor M4 in the pixel circuit are N-type transistors, and the third transistor M3 and the fifth transistor M5 are P-type transistors, and the first potential is low with respect to the second potential (that is, the voltage of the signal of the first potential is lower than the voltage of the signal of the second potential), the driving principle of the pixel circuit provided by the embodiment of the present disclosure is described in detail below.

Figure 5:
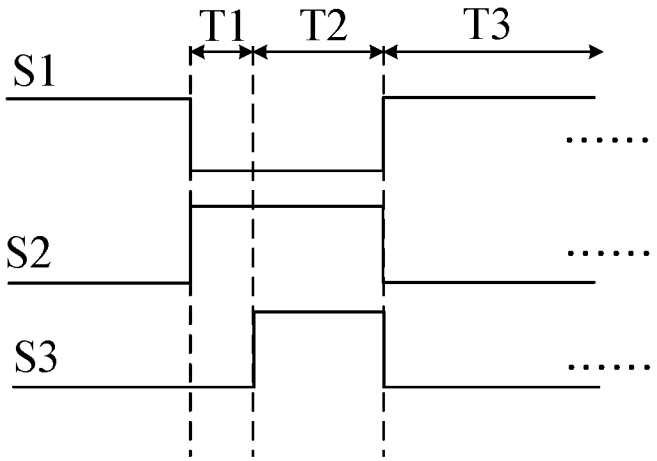
FIG. 5 is a timing diagram of signal terminals in a pixel circuit according to one embodiment of the present disclosure.

FIG. 5 is a timing diagram of signal terminals in a pixel circuit according to one embodiment of the present disclosure. As shown in FIG. 5, in the reset phase T1, the potential of the first control signal provided by the first control signal terminal S1 and the potential of the third control signal provided by the third control signal terminal S3 are both the first potential, and the potential of the second control signal provided by the second control signal terminal S2 is the second potential. For example, the voltage of the first control signal and the voltage of the third control signal are both negative voltages, and the voltage of the second control signal is a positive voltage. The first transistor M1, the third transistor M3, the fourth transistor M4, and the fifth transistor M5 are all turned on, and the second transistor M2 is turned off. The reference power terminal Vref outputs a reference power signal to the first node P1 through the third transistor M3, thereby achieving resetting of the first node P1. The data signal terminal D outputs a data signal to the second node P2 through the fourth transistor M4. The first power terminal ELVDD outputs a first power signal to the control node P3 through the fifth transistor M5 and the first transistor M1. The potential of the first power signal is the second potential.

For example, assuming that the voltage of the reference power signal is Vr, the voltage of the data signal is Vdata, and the voltage of the first power signal is Vdd. Referring to Table 1, in the reset phase T1, the potential of the first node P1 is: Vr, the potential of the second node P2 is: Vdata, and the potential of the control node P3 is: Vdd.

TABLE 1

| | P1's Potential | P2's Potential | P3's Potential |
|---|---|---|---|
| Reset Phase T1 | Vr | Vdata | Vdd |
| Data-Writing Phase T2 | Vr | Vdata | Vr + Vth |
| Light-Emitting Phase T3 | Vs | Vs | Vr + Vth + Vs − Vdata |

In the data-writing phase T2, the potential of the third control signal jumps to the second potential, and the fifth transistor M5 is turned off. Since the potential of the control node P3 becomes the second potential in the above-described reset phase T1, the driving transistor M0 is turned on in the data-writing phase T2. Since the potentials of the first control signal and the second control signal do not change during the data writing phase T2, the first transistor M1, the third transistor M3, and the fourth transistor M4 remain an "on" state, and the second transistor M2 remains an "off" state. Correspondingly, the potential of the first node P1 is maintained at Vr, and the potential of the second node P2 is maintained at Vdata. At this time, the voltage Vr of the reference power signal can be written to the first terminal of the driving transistor M0 through the driving transistor M0. Because the first transistor M1 is turned on, the first terminal of the driving transistor M0 and the gate thereof (i.e., the control node P3) are coupled, and the fifth transistor M5 is turned off. The first transistor M1 can adjust the potential of the control node P3 based on the potential of the first terminal of the driving transistor M0. That is, the first transistor M1 can write the threshold voltage Vth of the driving transistor M0 and the voltage Vr of the reference power signal to the control node P3. Therefore, referring to Table 1 above, in the data writing phase T2, the potential of the control node P3 becomes: Vr+Vth.

In the light-emitting phase T3, the potential of the first control signal jumps to the second potential, and the potentials of the second control signal and the third control signal both jump to the first potential. The second transistor M2 and the fifth transistor M5 are both turned on, and the first transistor M1, the third transistor M3, and the fourth transistor M4 are all turned off. At this time, the second transistor M2 can adjust the potential of the second node P2 based on the potential of the first node P1, that is, the second transistor M2 can write the potential (i.e., the source voltage) Vs of the second terminal of the driving transistor M0 to the second nodes P2. Referring to Table 1 above, the potential of the second node P2 becomes Vs. Since the potential of the second node P2 is Vdata in the data-writing phase T2, the amount of potential change of the second node P2 is Vs−Vdata in the light-emitting phase T3. Under the coupling of the storage capacitor C, the amount of the potential change of the control node P3 is also: Vs−Vdata. Therefore, referring to Table 1 above, in the light-emitting phase T3, the storage capacitor C can adjust the potential of the control node P3 to be: Vr+Vth+Vs−Vdata by coupling.

Meanwhile, in the light-emitting phase T3, the first power terminal ELVDD may output a first power signal to the first terminal of the driving transistor M0 through the fifth transistor M5. The driving transistor M0 can be turned on under the control of the control node P3, and outputs a driving current to the light-emitting element L to drive the light-emitting element L to emit light.

As can be seen from the above Table 1, in the light-emitting phase T3, the potential of the control node P3 (i.e., the gate voltage Vg of the driving transistor M0) is: Vr+Vth+Vs−Vdata. Therefore, in the light-emitting phase T3, the gate-source voltage Vgs of the driving transistor M0 (i.e., the voltage difference between the gate power source Vg and the source voltage Vs) is:

$$Vgs=Vg-Vs=Vr+Vth+Vs-V\text{data}-Vs=Vr+Vth-V\text{data} \quad (1);$$

Wherein, the driving current $I_{OLED}$ generated by the driving transistor M0 can be expressed as:

$$I_{OLED}=\frac{1}{2}\times\frac{W}{L}\times C_{ox}\times\mu\times(Vgs-Vth)^2; \quad (2)$$

Substituting the Vgs obtained by the above formula (1) into the formula (2), the driving current $I_{OLED}$ generated by the driving transistor M0 can be calculated as:

$$\begin{aligned} I_{OLED} &= \frac{1}{2}\times\frac{W}{L}\times C_{ox}\times\mu\times(Vgs-Vth)^2 \\ &= \frac{1}{2}\times\frac{W}{L}\times C_{ox}\times\mu\times(Vr+Vth-Vdata-Vth)^2 \\ &= \frac{1}{2}\times\frac{W}{L}\times C_{ox}\times\mu\times(Vr-Vdata)^2; \end{aligned} \quad (3)$$

Here, μ is carrier mobility of the driving transistor M0, $C_{OX}$ is capacitance of the gate insulating layer of the driving transistor M0, and W/L is a width/length ratio of the driving transistor M0.

It can be seen from the above formula (3) that, when the light-emitting element L is normally operated, the driving current $I_{OLED}$ for driving the light-emitting element L is only related to the voltage Vr of the reference power signal provided by the reference power terminal Vref and the voltage Vdata of the data signal provided by the data signal terminal D, regardless of the threshold voltage Vth of the driving transistor M0 and the voltage Vdd of the first power signal provided by the first power terminal ELVDD. Therefore, not only the problem of uneven display brightness of display panel due to the drift of the threshold voltage of the driving transistor M0 can be avoided, but also the problem of uneven display brightness of the display panel due to the voltage drop of the first power terminal ELVDD can be avoided, thereby effectively ensuring the uniformity of display brightness of the display panel.

In summary, the embodiments of the present disclosure provide a driving method of a pixel circuit. In the data writing phase, since the compensation sub-circuit can adjust the potential of the control node (i.e., the gate of the driving transistor) based on the potential of the first terminal of the driving transistor, and at this stage, the first power terminal cannot output the first power signal to the first terminal of the driving transistor. Therefore, the compensation sub-circuit can write the threshold voltage of the driving transistor and the voltage of the reference power signal to the gate of the driving transistor. Because in the light-emitting phase, the compensating sub-circuit can adjust the potential of the second node based on the potential of the first node (i.e., the second terminal of the driving transistor), and the storage sub-circuit can adjust the potential of the control node based on the potential of the second node. Therefore, the compensation sub-circuit can also write the voltage of the second terminal of the driving transistor and the voltage of the data signal to the gate of the driving transistor. Thereby, the signal finally written to the gate of the driving transistor includes the threshold voltage of the driving transistor, the voltage of the reference power signal, the voltage of the data signal, and the potential of the second terminal of the driving transistor, but not the voltage of the first power signal. Thereby, the magnitude of the driving current outputted by the driving transistor is independent of the voltage of the first power signal provided by the first power terminal. Therefore, the problem of uneven display brightness due to the voltage drop at the first power terminal is avoided.

Embodiments of the present disclosure provide a display substrate, which may include: a plurality of pixel units. Each of the pixel units may include a light-emitting element, and a pixel circuit, as shown in anyone of FIGS. 1 to 3, coupled to the light-emitting element.

In addition, one embodiment of the present disclosure further provides a display apparatus, which may include the display substrate provided by any of the above embodiments. The display apparatus may be: LTPO display apparatus, Micro LED display apparatus, liquid crystal panel, electronic paper, OLED panel, AMOLED panel, mobile phone, tablet computer, television, display, notebook computer, digital photo frame, and any product or part that has a display function.

The principles and the embodiments of the present disclosure are set forth in the specification. The description of the embodiments of the present disclosure is only used to help understand the apparatus and method of the present disclosure and the core idea thereof. Meanwhile, for a person of ordinary skill in the art, the disclosure relates to the scope of the disclosure, and the technical scheme is not limited to the specific combination of the technical features, but also covers other technical schemes which are formed by combining the technical features or the equivalent features of the technical features without departing from the inventive concept. For example, a technical scheme may be obtained by replacing the features described above as disclosed in this disclosure (but not limited to) with similar features.

What is claimed is:

1. A pixel circuit, comprising:

a compensation sub-circuit, and a storage sub-circuit;

wherein the compensation sub-circuit is respectively coupled to a first control signal terminal, a second control signal terminal, a first node, a second node, a control node and a first terminal of a driving transistor, and the control node is coupled to a gate of the driving transistor;

the compensation sub-circuit is configured to adjust a potential of the second node based on a potential of the first node in response to a first control signal from the first control signal terminal, and to adjust a potential of the control node based on a potential of the first terminal of the driving transistor in response to a second control signal from the second control signal terminal; and the storage sub-circuit is respectively coupled to the second node and the control node, and is configured to adjust the potential of the control node based on the potential of the second node, wherein the driving transistor is an N-type transistor;

the pixel circuit further includes a reset sub-circuit, a data writing sub-circuit, a light-emitting control sub-circuit, and a driving transistor;

the reset sub-circuit is respectively coupled to the third control signal terminal, a reference power terminal and the first node, and is configured to output a reference power signal provided by the reference power terminal to the first node in response to the third control signal from the third control signal terminal;

the data writing sub-circuit is respectively coupled to the second control signal terminal, a data signal terminal and the second node, and is configured to output a data signal provided by the data signal terminal to the second node in response to the second control signal from the second control signal terminal;

the light-emitting control sub-circuit is respectively coupled to a third control signal terminal, a first power terminal, and the first terminal of the driving transistor, and is configured to output a first power signal provided by the first power terminal to the first terminal of the driving transistor in response to a third control signal from the third control signal terminal; and the second terminal of the driving transistor is coupled to the first node, and the first node is coupled to one terminal of a light emitting element.

2. The pixel circuit according to claim 1, wherein the compensation sub-circuit comprising: a first compensation sub-circuit and a second compensation sub-circuit;

the first compensation sub-circuit is respectively coupled to the second control signal terminal, the control node, and the first terminal of the driving transistor, and is configured to adjust the potential of the control node based on the potential of the first terminal of the driving transistor in response to the second control signal; and the second compensation module is respectively coupled to the first control signal terminal, the first node, and the second node, and is configured to adjust the potential of the second node based on the potential of the first node in response to the first control signal.

3. The pixel circuit according to claim 2, wherein the first compensation sub-circuit comprises a first transistor;

a gate of the first transistor is coupled to the second control signal terminal, a first terminal of the first transistor is coupled to the first terminal of the driving transistor, and a second terminal of the first transistor is coupled to the control node.

4. The pixel circuit according to claim 2, wherein the second compensation sub-circuit comprises: a second transistor;

a gate of the second transistor is coupled to the first control signal terminal, a first terminal of the second transistor is coupled to the first node, and a second terminal of the second transistor is coupled to the second node.

5. The pixel circuit according to claim 2, wherein transistors included in the data writing sub-circuit and the first compensation sub-circuit are oxide thin film transistors.

6. The pixel circuit according to claim 2, wherein transistors in the second compensation sub-circuit are P-type thin film transistors, and all other transistors in the pixel circuit are N-type thin film transistors.

7. The pixel circuit according to claim 2, wherein the driving transistor and transistors in the second compensation sub-circuit are N-type thin film transistors, and all other transistors in the pixel circuit are P-type thin film transistors.

8. The pixel circuit according to claim 1, wherein the reset sub-circuit comprises a third transistor;

a gate of the third transistor is coupled to the third control signal terminal, a first terminal of the third transistor is coupled to the reference power terminal, and a second terminal of the third transistor is coupled to the first node.

9. The pixel circuit according to claim 1, wherein the data writing sub-circuit comprises a fourth transistor;

a gate of the fourth transistor is coupled to the second control signal terminal, a first terminal of the fourth transistor is coupled to the data signal terminal, and a second terminal of the fourth transistor is coupled to the second node.

10. The pixel circuit according to claim 1, wherein the light-emitting control sub-circuit comprises a fifth transistor;

a gate of the fifth transistor is coupled to the third control signal terminal, a first terminal of the fifth transistor is coupled to the first power terminal, and a second terminal of the fifth transistor is coupled to the first terminal of the driving transistor.

11. The pixel circuit according to claim 1, wherein the storage sub-circuit comprises a storage capacitor;

one terminal of the storage capacitor is coupled to the second node, and the other terminal of the storage capacitor is coupled to the control node.

12. The pixel circuit according to claim 1, wherein all transistors in the pixel circuit are oxide thin film transistors or N-type LTPS thin film transistors.

13. The pixel circuit according to claim 1, wherein all transistors except the driving transistor in the pixel circuit are P-type thin film transistors.

14. The pixel circuit according to claim 1, wherein transistors included in the data writing sub-circuit and the compensation sub-circuit, and the driving transistor are all N-type transistors, and transistors included in the reset sub-circuit and the light-emitting control sub-circuit are all P-type transistors.

15. A display substrate, comprising: a plurality of pixel units, each of the pixel units comprising a pixel circuit according to claim 1.

16. A display apparatus, comprising a display substrate according to claim 15.

17. A driving method of a pixel circuit, wherein the pixel circuit comprises a compensation sub-circuit, and a storage sub-circuit, wherein the compensation sub-circuit is respectively coupled to a first control signal terminal, a second control signal terminal, a first node, a second node, a control node and a first terminal of a driving transistor, and the control node is coupled to a gate of the driving transistor;

the compensation sub-circuit is configured to adjust a potential of the second node based on a potential of the first node in response to a first control signal from the first control signal terminal, and to adjust a potential of the control node based on a potential of the first terminal of the driving transistor in response to a second control signal from the second control signal terminal;

the storage sub-circuit is respectively coupled to the second node and the control node, and is configured to adjust the potential of the control node based on the potential of the second node; and the driving transistor is an N-type transistor;

the method comprises a reset phase, a data-writing phase, and a light-emitting phase, wherein in the reset phase, the potential of the first control signal provided by the first control signal terminal is the first potential, the potential of the second control signal provided by the second control signal terminal is the second potential, and the potential of the third control signal provided by the third control signal terminal is the first potential; the reset sub-circuit outputs a reference power signal from the reference power terminal to the first node in response to the first control signal; the data writing sub-circuit outputs the data signal from the data signal terminal to the second node in response to the second control signal; the light-emitting control sub-circuit outputs a first power signal from the first power terminal to the first terminal of the driving transistor in response to the third control signal; the compensation sub-circuit outputs the first power signal to the control node in response to the second control signal; the potential of the first power signal is a second potential;

in the data-writing phase, the potential of the third control signal is a second potential, the driving transistor outputs a reference power signal to the first terminal of the driving transistor in response to the control node; the compensation sub-circuit adjusts a potential of the control node based on a potential of the first terminal of the driving transistor in response to the second control signal; and in the light-emitting phase, the potential of the first control signal is a second potential, the potential of the second control signal is a first potential, and the potential of the third control signal is a first potential; the compensation sub-circuit adjusts the potential of the second node based on the potential of the first node in response to the first control signal; the storage sub-circuit adjusts the potential of the control node based on the potential of the second node; the light-emitting control sub-circuit outputs a first power signal to the first terminal of the driving transistor in response to the third control signal.

18. The method according to claim 17, wherein the compensation sub-circuit comprising: a first compensation module and a second compensation module; the first compensation module comprising a first transistor, the second compensation module comprising a second transistor, the reset sub-circuit comprising a third transistor, the data writing sub-circuit comprising a fourth transistor, the light-emitting control sub-circuit comprising a fifth transistor, and the storage sub-circuit comprising a storage capacitor C;

in the reset phase, the potentials of the first control signal and the third control signal are both the first potential, and the potential of the second control signal is the second potential; the first transistor, the third transistor, the fourth transistor, and the fifth transistor are all turned on, and the second transistor is turned off; the reference power terminal outputs the reference power signal to the first node through the third transistor, the data signal terminal outputs the data signal to the second node through the fourth transistor, and the first power terminal outputs the first power signal to the control node through the first and fifth transistors;

in the data-writing phase, the potential of the third control signal is the second potential, the potential of the control node is the second potential, the driving transistor is turned on, and the fifth transistor is turned off, the reference power signal is outputted to the first terminal of the driving transistor through the driving transistor, and the first transistor adjusts the potential of the control node based on the potential of the first terminal of the driving transistor;

in the light-emitting phase, the potential of the first control signal is the second potential, the potential of the second control signal and the potential of the third control signal are the first potential; the second transistor and the fifth transistor are turned on, the first transistor, the third transistor, and the fourth transistor are turned off; the second transistor adjusts the potential of the second node based on the potential of the first node, the storing capacitor adjusts the potential of the control node based on the potential of the second node, and the first power terminal outputs the first power signal to the first terminal of the driving transistor through the fifth transistor.

* * * * *